United States Patent [19]

Oda et al.

[11] 4,339,310

[45] Jul. 13, 1982

[54] METHOD OF SURFACE TREATMENT OF TIN PLATED CANS AND TIN PLATED STEEL SHEETS

[75] Inventors: Nobuyuki Oda, Yokohama; Haruyoshi Terada, Tanashi, both of Japan

[73] Assignee: Hooker Chemicals & Plastics Corp., Warren, Mich.

[21] Appl. No.: 210,706

[22] Filed: Nov. 26, 1980

[51] Int. Cl.[3] ..... C23F 7/14

[52] U.S. Cl. ..... 204/38 R; 106/14.12; 148/6.15 R; 204/56 R

[58] Field of Search ..... 148/6.15 R; 106/14.12; 204/38 R, 42, 56 R

[56] References Cited

U.S. PATENT DOCUMENTS

| | | | |
|---|---|---|---|
| 3,839,099 | 10/1974 | Jones | 148/6.15 R |
| 3,957,543 | 5/1976 | Shinomiya et al. | 148/6.15 R |
| 4,017,334 | 4/1977 | Matsushima et al. | 148/6.15 R |
| 4,101,441 | 7/1978 | Hwa et al. | 252/389 A |
| 4,187,127 | 2/1980 | Yashiro | 148/6.15 R |
| 4,217,216 | 8/1980 | Lipinski | 210/58 |

FOREIGN PATENT DOCUMENTS

| | | | |
|---|---|---|---|
| 54-71734 | 6/1979 | Japan | 148/6.15 R |

*Primary Examiner*—Delbert E. Gantz
*Assistant Examiner*—William Leader
*Attorney, Agent, or Firm*—Richard P. Mueller; Arthur E. Kluegel

[57] ABSTRACT

An aqueous chromium-free composition is useful for imparting a corrosion resistance paintable coating to a tin surface. The composition contains a titanium or zirconium compound, a pyrazole derivative, a myoinositol phosphate ester and a silicon compound. The surface is either chemically coated via contact with the composition or electrolytically coated via immersion in the composition.

8 Claims, No Drawings

METHOD OF SURFACE TREATMENT OF TIN PLATED CANS AND TIN PLATED STEEL SHEETS

BACKGROUND OF THE INVENTION

This invention is concerned with a method for the surface treatment of tin plated steel sheet (referred to below as tin plate) and drawn and ironed cans of tin plated steel sheet (referred to below as tin cans). It is an object to form a coating on the tin surface which is corrosion resistant and oxidation resistant and exhibits good paintability either chemically or electrolytically.

In the past aqueous solutions of phosphoric acid and chromic acid or chromic acid salts in aqueous solution have been used as surface treatment baths for tin surfaces. Surface treatment methods based on chromic acid salts of this sort are excellent surface treatment methods for tin but there is a disadvantage in that effluent treatment is needed to prevent pollution and there are further disadvantages in connection with environmental health and with operability, etc. Furthermore, tin plate cans are often employed as food or beverage containers where the presence of chromium is not desirable.

SUMMARY OF THE INVENTION

Thus in order to overcome these disadvantages the inventors have found that it is possible to provide a film that is better than the surface treatment films of the chromic acid salt system and to form a coating which has improved corrosion resistance, oxidation resistance and paintability for DI tin cans and tin plate. The tin surface is given either a chemical or an electrolytic treatment in an aqueous solution at pH 1.0–10 which contains as its main components (1) at least one soluble compound of a metal selected from the group consisting of titanium and zirconium; (2) at least one pyrazole compound of the formula:

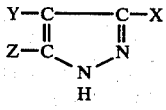

(Where X, Y and Z are independently selected from the group consisting of hydrogen atom, hydroxyl group, alkyl group of up to five carbon atoms, amino group, and nitro group.)

(3) at least one myoinositol phosphate ester having 2–6 phosphate groups per molecule or a salt thereof and; (4) at least one silicon compound.

DETAILED DESCRIPTION OF THE INVENTION

The titanium salts that can be used in this invention include any soluble compound such as titanium hydrofluoride and its alkali metal salts, for example the ammonium, sodium, potassium, or lithium salts, titanyl sulphate, titanium hydroxide, and titanium oxalate; and the zirconium salts that can be used in this invention include any soluble salt such as zirconium hydrofluoride and its alkali metal salts, zirconium sulphate, zirconium hydroxide, zirconium fluoride, zirconium carbonate, and zirconium nitrate.

The total concentration of the titanium and zirconium compounds is 0.001–10 g/l and desirably 0.01 g/l.

Examples of the pyrazole dervatives that are expressed by the general formula:

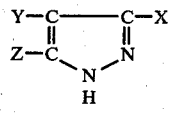

(Where X, Y and Z are hydrogen atom, hydroxyl group, alkyl group of up to five carbon atoms, amino group, and nitro group.)

include 3-methyl-5-hydroxypyrazole, 3,5-dimethylpyrazole, 3-methyl-4-amino-5-hydroxypyrazole and 4-aminopyrazole.

The total concentration of the pyrazole derivatives is 0.01–20 g/l and desirably 0.1–5 g/l.

Examples of the myoinositaol 2–6 phosphate esters used in this invention include myoinositol diphosphate ester, myoinositol pentaphosphate ester, and myoinositol hexa phosphate ester and the salts of the myoinositol 2–6 phosphate esters include the alkali metal salts and the alkaline earth metal salts and water soluble salts in which hydrogen groups of the said phosphate esters are replaced by a soluble metal such as Na, K, Li, Mg, Ca, Sr, and Ba.

Since the myoinositol hexaphosphate ester is commonly named phytic acid, this is called phytic acid. Furthermore, since the myoinositol di-penta phosphate esters are obtained mainly by the hydrolysis of phytic acid, phytic acid is the most useful industrially.

The overall concentration of the myoinositol 2–6 phosphate esters calculated as phosphoric acid is 0.005–50 g/l and desirably 0.01–10 g/l.

The silicon compounds used in this invention include silicic acids such as orthosilicic acid, metasilicic acid and their alkali metal salts, silicon hydrofluoride and its alkali metal salts, ammonium silicafluoride, and colloidal silica as inorganic silicon compounds and organic silicon compounds such as the silane derivates which include alkoxy groups or acetoxy groups which are generally called silane coupling agents.

Examples include:

γ-amino propyltriethoxysilane $H_2NC_3H_6Si(OC_2H_5)_3$

N-β(aminoethyl)-γ-aminopropyltrimethoxysilane $H_2NC_2H_4NHC_3H_6Si(OCH_3)_2$

N-β(aminoethyl)-γ-aminopropylmethyldimethoxysilane

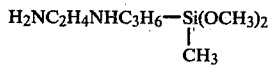

γ-Glycitoxypropyltrimethoxysilane

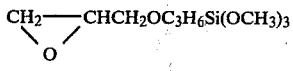

Vinyltris(β-methoxyethoxy)silane $CH_2{=}CHSi(OC_2H_5OCH_3)_3$

The total concentration of the silicon compound(s) calculated as silicon is 0.001–10 g/l and preferably 0.005–1 g/l.

One method for the preparation of the aqueous solution that is used in this invention involves dissolving the pyrazole derivative(s) in water and then dissolving the myoinositol phosphate ester. The titanium or zirconium compound(s) are then dissolved in water or in an inorganic acid such as hydrofluoric acid, sulphuric acid, or nitric acid and added to this solution. Then the silicon compound(s) are added and dissolved in this aqueous solution. In the case of the inorganic silicon compounds the compounds are first dissolved in water or an inorganic acid and then added to the aqueous solution. After dissolving all of the above mentioned components the pH is adjusted to 1.0–10. If the pH is less than 1.0 or more than 10.0 the etching reaction becomes severe and it is difficult to obtain a good coating.

Inorganic acids such as hydrofluoric acid, nitric acid, sulphuric acid, phosphoric acid and condensed phosphoric acid and caustic alkalis such as sodium hydroxide, potassium hydroxide, lithium hydroxide, ammonium hydroxide, triethanolamine, diethanolamine, and monoethanolamine can be used as acids and alkalis for adjusting the pH.

Oxidizing agents or reducing agents can be added as required and examples of oxidizing agents and reducing agents that can be used include sodium nirite, potassium nitrite, ammonium nitrite, sodium chlorate, potassium chlorate, sodium perborate, sodium bromate, potassium bromate, phosphorous acid, sodium phosphite, zinc phosphite, hypophosphorous acid, sodium hypophosphite, calcium hypophosphite, hydrazine hydrate, hydrazine sulphate, hydrazine phosphate, hydrazine hydrochloride, and hydrazine oxalate.

The rate of coating formation is controlled by adding these oxidizing agents or reducing agents and in this way it is possible to obtain the desired coating.

The method of treatment is as follows: The tin cans or the tin plate that has been cleaned by a degreasing water wash by the usual methods is immersed for 5–10 seconds in the above mentioned aqueous solution that has been heated to 10°–90° C. and a coating is formed in the same way as in the conventional treatment or alternatively the tin plate which is to be treated is made the anode and then using a carbon plate or a stainless plate for the other electrode the above mentioned cleaned tin can or tin plate is given an anodic electrolysis treatment or an alternating current electrolytic treatment by spacing the poles at a distance of 5–500 mm and passing a current for from 0.1 seconds to 2 minutes at a current density of 0.1–50 A/dm$^2$, desirably at 1–10 A/dm$^2$ and then, after carrying out the electrolytic treatment, the tin can or tin plate is washed with water and dried. As required, the product may be dried without a water wash after forming the skin film by an electrolytic treatment or after simply painting with the aqueous solution of this invention by any conventional means such as spray coating, roll coating, or electrostatic coating.

The coated surface has the advantages of improving corrosion resistance, improved oxidation resistance and improved paintability and furthermore since the aqueous solutions of this invention do not contain any chromium there are considerable advantages in connection with effluent treatment, environmental health and operability.

EXAMPLE 1

3-methyl-5-hydroxypyrazole (10 g) was dissolved in tap water (8 l) and phytic acid (5 g) and 20 wt% in water of zirconium hydrofluoride (25 g) were then dissolved successively in this solution. Then, 5 g of γ-aminopropyltriethoxysilane and 2 g of 55% hydrofluoric acid were added and dissolved and then, after the addition of 2 g of 30% aqueous hydrogen peroxide the total volume was made up to 10l by adding tap water. The pH of this aqueous solution was 2.7.

After cleaning a tin plate can be degreasing with a solution of 10 g/l of a conventional alkaline degreasing agent and rinsing with water, a coating was formed by spraying the surface for 30 seconds at 1.0 kg/cm$^2$ (gauge pressure) with the above mentioned aqueous solution heated to 45° C. after which the residual aqueous solution was removed by first rinsing with tap water for 20 seconds and then by spraying with deionised water with a specific resistance in excess of 500,000 ohm.cm the can was dried for 3 minutes in a hot air convection oven at 200° C.

For a paintability test, an epoxy based inner surface paint for use on tin (Trade Name: "CanCoat" Kannishi Paint) was painted on part of the treated surface so as to give a dry paint film thickness of about 5/μ and the can was heated for 4 minutes in a hot air convection oven at 22° C.

The results of testing the treated can, with and without painting are shown in Table 1.

EXAMPLE 2

3-methyl-5-hydroxypyrazole (12 g) was dissolved in tap water (5 l) and then phytic acid (10 g) was added to make up solution A. Potassium fluotitanate (10 g) and 40% silicon tetrafluoride (20 g) were then dissolved in 4 l of tap water to make up solution B. Then after mixing solutions A and B and adding and dissolving sodium nitrate (10 g) the total volume was made up to 10 l with tap water. The pH was adjusted to 9.0 using aqueous ammonia to yield the aqueous solution.

A coating was then formed on a tin can that had been cleaned using the same method as in Example 1 by spraying for 20 seconds at 0.8 kg/cm$^2$ (gauge pressure) with the above mentioned aqueous solution that had been heated to 40° C. and the residual aqueous solution was then removed by first rinsing for 10 seconds in tap water and then 10 seconds in deionized water (resistance in excess of 300,000 ohm.cm) followed by drying in a hot air convection oven at 150° C. The can was painted in the same way as in Example 1. The results of testing are shown in Table 1.

EXAMPLE 3

After cleaning a tin can in the same way as in Example 1, the can was immersed for 10 seconds in the same aqueous solution as used in Example 1 and dried for 3 minutes after removal from the aqueous solution in a hot air convection oven at 120° C. without first rinsing with water. The can was painted in the same way as in Example 1. The results of testing are shown in Table 1.

COMPARATIVE EXAMPLE 1

For purposes of comparing Examples 1 to 3 with chromic acid based treatments, after cleaning a tin can in the same way as in Example 1, except the treatment was as follows:

| | | |
|---|---|---|
| Composition of the Aqueous Solution: | | |
| Anhydrous chromic acid | 40g | made up to 10l with water |
| Phosphoric acid (75%) | 20g | |
| Aqueous Solution Temperature | 30° C. | |
| Treatment Conditions: | | |
| Spray treatment (spray pressure: | 0.5kg/cm$^2$ gauge pressure) | |
| Spray time | 30 secs. | |

Results of testing are shown in Table 1.

COMPARATIVE EXAMPLE 2

An aqueous solution was made by the method outlined in Example 1 but the zirconium hydrofluoride was omitted and the pH was adjusted to 3 with hydrofluoric acid. A can was processed as in Example 1 and the results of testing are shown in Table 1.

COMPARATIVE EXAMPLE 3

An aqueous solution was made by the method outlined in Example 1 but the phytic acid was omitted and the pH was adjusted to 3 using aqueous ammonia. A can was processed as in Example 1 and the results of testing are shown in Table 1.

COMPARATIVE EXAMPLE 4

An aqueous solution was made by the method outlined in Example 1 but the γ-aminopropyltriethoxysilane was omitted and the pH of this aqueous solution was adjusted to 3 with aqueous ammonia. A can was processed as in Example 1 and the results of testing are shown in Table 1.

EXPERIMENTAL RESULTS

TABLE 1

| | Treated Only Can | | Painted Can |
|---|---|---|---|
| Example Number | Corrosion Resistance | Moisture Resistance | Adhesion of Paint Film |
| 1 | 5 points | 5 points | 5 points |
| 2 | 5 | 5 | 5 |
| 3 | 5 | 5 | 5 |
| Comparative 1 | 4.5 | 5 | 5 |
| Comparative 2 | 1 | 1 | 4 |
| Comparative 3 | 1 | 1 | 3 |
| Comparative 4 | 2 | 1 | 4 |

Test Methods for Table 1

Corrosion Resistance Test

The tin can specimen was placed base up and introduced into a salt water spray tester and after testing for 30 minutes as prescribed in JIS-Z-2371 the tarnished condition of the surface of the tin can was assessed. The scale of assessment was as follows: No tarnishing 5 points, tarnishing over the whole surface 1 point with intermediate scores for intermediate states of tarnishing.

Moisture Resistance Test

The tin can specimen was placed base up and introduced into a moisture tester in accordance with JIS-Z-0228, the state of tarnishing of the surface of the tin can was assessed after a three hour test. The assessment was made on the same basis as the corrosion resistance test.

Test of the Adhesion of the Paint Film

After immersing the painted can for 30 minutes in a 1% aqueous solution of citric acid it was washed with water and dried. Then, after making an X shaped cut in the paint surface on the outer surface of the specimen through to the underlying metal with a sharp blade, cellophane adhesive tape was applied and the extent of paint removal when the tape was pulled off was assessed. Evaluation was made on the following basis: No separation of the paint film at all—5 points, paint film almost completely removed—1 point and intermediate scores for conditions of removal intermediate these two extremes.

EXAMPLE 4

3 methyl-5-hydroxypyrazole (5 g) and 3,5-dimethylpyrazole (5 g) were dissolved in tap water (8 l) and then phytic acid (10 g), 40% titanium hydrofluoride (10 g), 20% zirconium hydrofluoride (10 g) and acidified ammonium fluoride (5 g) were added successively and dissolved and then γ-aminopropyltriethoxysilane (10 g) was dissolved in this solution. After making up to a total volume of 10 l with tap water, the pH was adjusted to 4 with aqueous ammonia.

After cleaning a #50 tin plate panel (0.3×70×150 mm) using the same method as in Example 1 it was treated using the above mentioned aqueous solution under the conditions noted below, rinsed with water and dried.

The results of testing are shown in Table 2.

| Treatment Conditions | |
|---|---|
| Aqueous solution temperature | 50° C. |
| Type of electrolysis | Direct current electrolysis |
| Current density | 3A/dm$^2$ |
| Time for which the current was passed | 5 seconds |
| Pole ratio | 1:1 |
| Distance between poles | 50mm |
| Anode | Tin plate specimen |
| Cathode | Carbon sheet |

COMPARATIVE EXAMPLE 5

For comparison with Example 4 using conventional chromic acid salt based treatments a sheet of #50 tin plate (0.3×70×150 mm) was cleaned with the same method as used in Example 1 and then given an electrolytic treatment in accordance with the conditions of treatment noted for Example 4 using the aqueous solution of Comparative Example 1 rinsed with water and dried.

The results of testing are shown in Table 2.

EXAMPLE 5

After dissolving 3-methyl-5-hydroxypyrazole (10 g) in distilled water (8 l), phytic acid (10 g) 40% titanium hydrofluoride (1 g) and acid ammonium fluoride (10 g) were added successively and dissolved and then γ-aminopropyltriethoxysilane (5 g) was added and dissolved.

The total volume was made up to 10 l with distilled water and the pH was adjusted to 8.5 with aqueous ammonia.

After cleaning a #50 tin plate panel (0.3×70×150 mm) by the same method as that used in Example 1 and immersing it for 5 seconds in the above solution which had been heated to 30° C., the excess aqueous solution was removed in such a way as to leave an aqueous solution coating of 5 ml/m$^2$ using neoprene rubber rollers and then the panel was dried in a hot air convection oven at 150° C.

The results of testing are shown in Table 2.

COMPARATIVE EXAMPLE 6

An aqueous solution was made up as in Example 5 but the phytic acid was omitted and the pH was adjusted to pH 8.5 with aqueous ammonia and a panel treated as in Example 5.

TABLE 2

| Example Number | Corrosion Resistance | Oxidation Resistance | Paintability |
|---|---|---|---|
| 4 | 5 points | 5 points | 5 points |
| 5 | 5 | 5 | 5 |
| Comparative 5 | 5 | 5 | 5 |
| Comparative 6 | 2 | 3 | 4 |

Test Methods for Table 2

Corrosion Resistance Test

Specimens were placed in a salt water spray tester and after testing for 24 hours according to JIS-Z-2371 the state of tarnishing was assessed. The evaluation was made as follows: No tarnishing developed—5 points, tarnish developed over the whole surface—1 point, states of tarnishing between these extremes, intermediate scores.

Oxidation Resistance Test

After heating a specimen for 30 minutes in an electric oven (air atmosphere) at 210° C. the extent of yellowing was assessed visually. The evaluation was made as follows: No color change at all—5 points, color change to a stron yellow color—1 point, color changes between these extremes—intermediate scores.

Paintability Test

Five ml of an epoxy based can paint (Trade Name: "Can Coat", Kannishi Paint) was dripped by pipette onto the surface of a specimen that was held horizontally and the way in which the paint spread out was assessed.

The evaluation was made as follows: Paint spread out and did not leave droplets—5 points, the paint remained in the form of the droplets—1 point, intermediate extent of spreading out—intermediate scores.

What is claimed is:

1. A chromium-free aqueous composition, comprising:

(a) at least one soluble compound selected from the group consisting of titanium and zirconium compounds;

(b) at least one pyrazole compound of the formula:

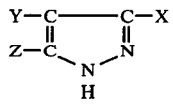

wherein X, Y and Z are independently selected from the group consisting of hydrogen atom, hydroxyl group, alkyl group of up to 5 carbon atoms, amino group and nitro group;

(c) at least one myoinositol phosphate ester having 2–6 phosphate groups per molecule; and (d) at least one silicon compound;

said composition exhibiting a pH value in the range of from 1.0 to 10.0.

2. The composition of claim 1 wherein the concentration of the components is:

(a) 0.001–10 g/l (calculated as Zr or Ti)

(b) 0.01–20 g/l (c) 0.005–50 g/l (calculated as phosphoric acid)

(d) 0.001–10 g/l (calculated as silicon)

3. The composition of claim 2 wherein the concentration of the components is:

(a) 0.01–1.0 g/l (calculated as Zr or Ti)

(b) 0.1–5 g/l (c) 0.01–10 g/l (calculated as phosphoric acid)

(d) 0.005–1 g/l (calculated as silicon)

4. The composition of claim 1 additionally containing an oxidizing or reducing agent.

5. A process for forming a coating on a tin surface comprising contacting the surface with the composition of claim 1 at a temperature of 10°–90° C. for a time sufficient to form the coating.

6. The process of claim 5 wherein the surface is immersed in the composition and electrolyzed with the surface as anode.

7. The process of claim 6 wherein the surface is subjected to a current density of 0.1–50 A/dm$^2$ for 0.1 second to 2 minutes.

8. The process of claim 5, 6, or 7 wherein the coated surface is painted.

* * * * *